United States Patent [19]

Hackman et al.

[11] 3,930,438

[45] *Jan. 6, 1976

[54] METHOD FOR COMBINING PARTITION AND BOX BLANK AND FOR MAKING A DOUBLE WALL THICKNESS BOX

[75] Inventors: Howard T. Hackman; Ray Brown, both of Savannah, Ga.; William H. Friend, Martinsville, N.J.; Stuart L. Natof, Lovettsville, Va.; Eugene A. Reiter, Louisville, Ky.; David W. Rudman, Wysox, Pa.

[73] Assignee: Union Camp Corporation, Wayne, N.J.

[ * ] Notice: The portion of the term of this patent subsequent to June 4, 1991, has been disclaimed.

[22] Filed: May 8, 1974

[21] Appl. No.: 468,161

[52] U.S. Cl. ..... 93/37 R; 93/36.01

[51] Int. Cl.[2] ..... B31B 11/02

[58] Field of Search ..... 93/37 R, 37 SP, 37 EC, 93/36.01, 49 R, 52

[56] References Cited

UNITED STATES PATENTS

| | | | |
|---|---|---|---|
| 2,273,470 | 2/1942 | Gardner | 93/36.01 |
| 2,296,896 | 9/1942 | Bergstein | 93/36.01 |
| 2,615,378 | 10/1952 | Bergstein | 93/37 SP |
| 2,706,935 | 4/1955 | Pasjack | 93/37 R |
| 3,104,596 | 9/1963 | Bergstein et al. | 93/36.01 |
| 3,302,538 | 2/1967 | Hepworth | 93/36.01 |
| 3,381,593 | 5/1968 | Gentry | 93/37 SP |
| 3,813,999 | 6/1974 | Friend et al. | 93/37 R |

*Primary Examiner*—James F. Coan

*Attorney, Agent, or Firm*—Charles P. Bauer, Esq.

[57] ABSTRACT

The method of assembly of a partition with a box blank to form a combination partition box in collapsed condition for shipping and use and for making a double wall thickness box.

2 Claims, 19 Drawing Figures

Fig. 6.
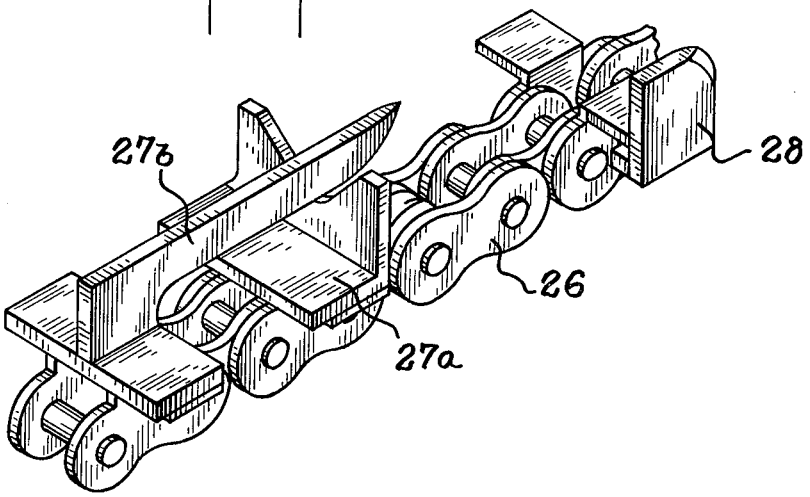
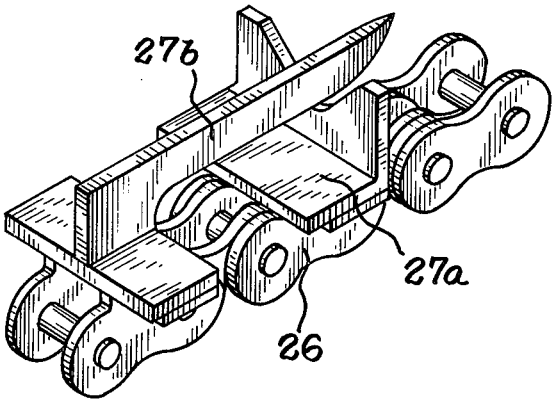
Fig. 5.

METHOD FOR COMBINING PARTITION AND BOX BLANK AND FOR MAKING A DOUBLE WALL THICKNESS BOX

CROSS-REFERENCES TO RELATED APPLICATIONS AND BACKGROUND OF THE INVENTION

There is disclosed in the patent application, now U.S. Pat. No. 3,580,471, issued May 25, 1971, in copending U.S. application Ser. No. 143,391, filed May 14, 1971, now abandoned and in copending U.S. application Ser. No. 433,978, filed Jan. 16, 1974, a collapsible cellular box partition and the method and apparatus for the continuous manufacture of such partition respectively. Copending U.S. application Ser. No. 293,941, filed Oct. 2, 1972, now U.S. Pat. No. 3,813,999, issued June 4, 1974, discloses and claims the apparatus for combining such collapsible cellular partitions with a box blank to form a collapsed shipping container which can be set up into a partition box while the present application discloses and claims the method carried out by the apparatus of the copending application Ser. No. 293,941 and the new uses of such apparatus for combining other forms of partitions with a box blank and making a double wall thickness box.

NOTICE OF TERMINAL DISCLAIMER

The assignee of the present application disclaims all of that portion of the term of the patent issuing on the present application subsequent to the expiration date of copending application Ser. No. 293,941, filed Oct. 2, 1972, granted on the above-identified application as U.S. Pat. No. 3,813,999.

SUMMARY OF THE INVENTION

It is an object of the invention to provide the method for assembling a partition with a box blank to form a combination partition box by the apparatus claimed in copending application Ser. No. 293,941. In the present method box blanks are fed onto a conveyor for carrying the blanks through the various operations. Adhesive is applied to the blank to bond the partition to the blank. The blanks then pass beneath a turning drum section where the partitions are gripped on the drum and then placed on the blank in exact register. The panels of the box blank are then folded over the partition to complete the formation of the box blank around the partition.

The method for carrying out the old and new operations of the apparatus claimed in copending application Ser. No. 293, 941, filed Oct. 2, 1972, comprises a sequence of feeding, gripping, holding, advancing and drum rotating steps for adhesively inserting a single wall partitions, separate box shaped partitions having four walls and inverted U-shaped partitions having three walls within the box blank to provide a particular sequence of operating steps which could be carried out by hand if the drum and conveyor arrangements were not employed or if the adhesive pattern applying means were not employed. In short, the method of the present invention is that carried out by the machine claimed in the copending case and under this method new uses of the apparatus of the copending case Ser. No. 293,941 are provided for the production of partitioned boxes and for double wall thickness boxes.

BRIEF DESCRIPTION OF THE DRAWINGS

Other objects and advantages will become apparent from the following description which is to be taken in conjunction with the accompanying drawings, in which:

FIG. 5 is a perspective view of the hold down pusher affixed to the blank conveyors showing the pusher for moving the blank and a sword which prevents the blank from riding over the top of the pusher;

FIG. 6 is a perspective view showing the hold down pusher of FIG. 5 and the reference line blade which engages a slot on the box blank and holds it in lateral registration;

FIG. 9 is a side elevation of the turning drum section showing the sucker mechanism for feeding a partition to the grippers on the drum;

DESCRIPTION OF THE PREFERRED EMBODIMENTS

Figure 1:
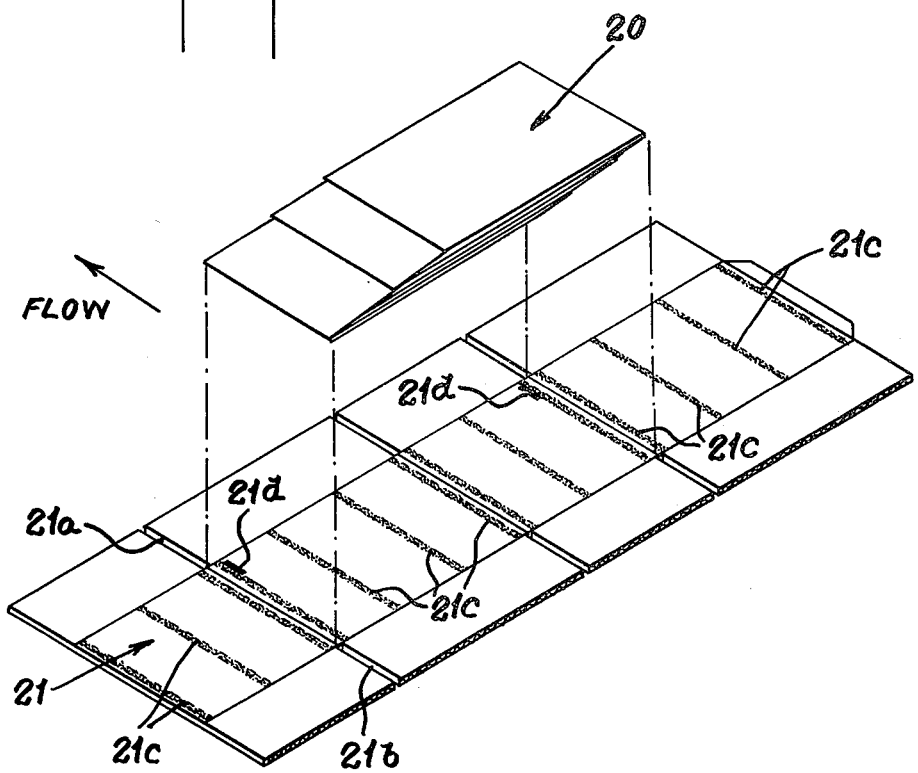
FIG. 1 is a perspective view showing how the partition is to be placed on top of a box blank on which lines of adhesive have been applied.

The collapsible cellular box partition, referred to herein and covered by U.S. Pat. No. 3,580,471, is formed from a plurality of modules. A module is a structure made up of a plurality of cells running across the structure. A number of modules can be stacked in stepped registry to form a partition unit of any desired cell numbers in either dimension. In superimposing modules on top of each other it is necessary to offset each module one cell from the module below it. This is shown in FIG. 1 where the partition unit 20 is above the box blank 21. As the partition units come off the end of the machine, described and claimed in copending applications Ser. Nos. 143,391 and 433,978, they are on a conveyor section with the partition units in stepped or shingled registry. It is in this form that the partition units enter the separating and holding section of the present machine, as hereinafter described. The box blanks are received from the conventional printing and slotting operations in the box plant and fed into the kicker feed mechanism of the present machine, as hereinafter described.

NEW USE FOR MACHINE COVERED BY APPLICATION SER. NO. 293,941

It has been found that the machine covered by application Ser. No. 293,941 can be used not only for combining collapsible cellular box partitions with box blanks, as heretofore described, but that such machine can also be effectively used for combining other forms of partitions or walls with box blanks. Such forms can be, for example, a single sheet divider, a tube, a U-shaped sheet or a double wall box.

The machine hereinafter described is used in the same manner for such other forms of partitions as for the cellular partitions. FIG. 13 shows such other forms and the adhesive patterns which would be used on the box blank for each form.

GENERAL DESCRIPTION

Figure 3:
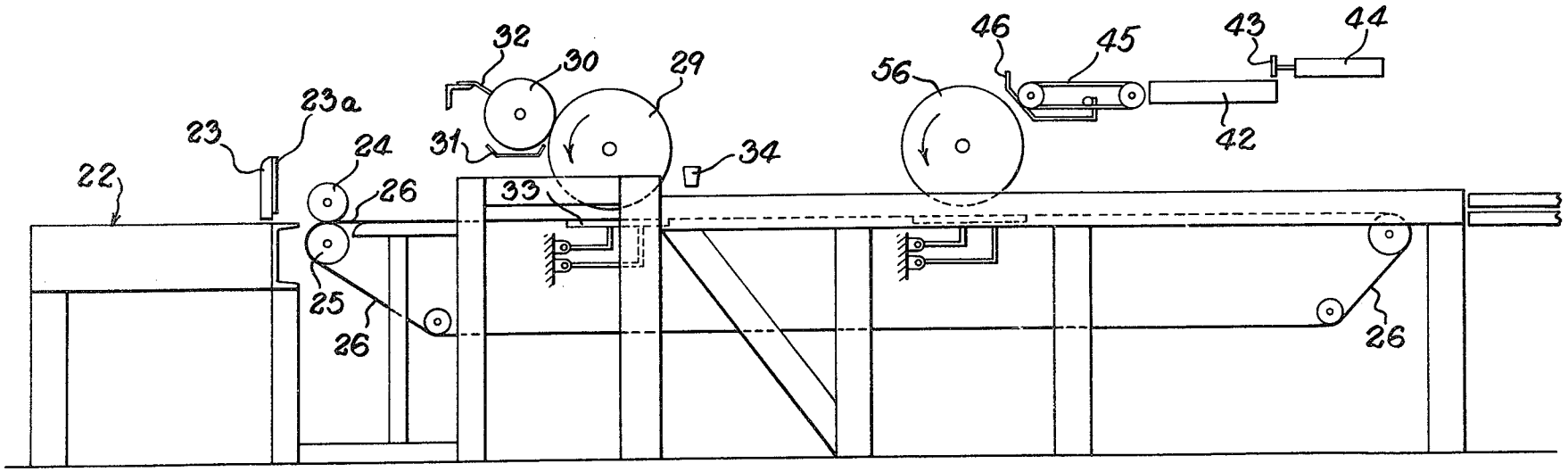
FIG. 3 is a side elevation of the machine of the present invention.

A side elevation of the machine of the present invention is shown in FIG. 3. Box blanks 21 are fed by hand into a kicker feeder mechanism. Individual blanks are fed, one at a time, from this feeder onto a chain type, blank conveyor. This conveyor is equipped with a plurality of sets of lugs which engage the trailing edge of the blank and push it, in controlled registration, through the following operations. The blank is positioned so that the slots of the blanks are in line with the path of motion of the blank through the machine.

The blank first passes through an adhesive section which applies the adhesive to bond the partition and blank together. This adhesive is applied to the upper surface of the box blank, which is actually the inside surface of the box, as it is passing through the machine.

The blanks then pass beneath a turning drum section where the partition 20 is placed on the blank, in exact register both laterally and vertically. The box partition combination then passes into a folder which completes the formation of the box around the partition.

Figure 4:
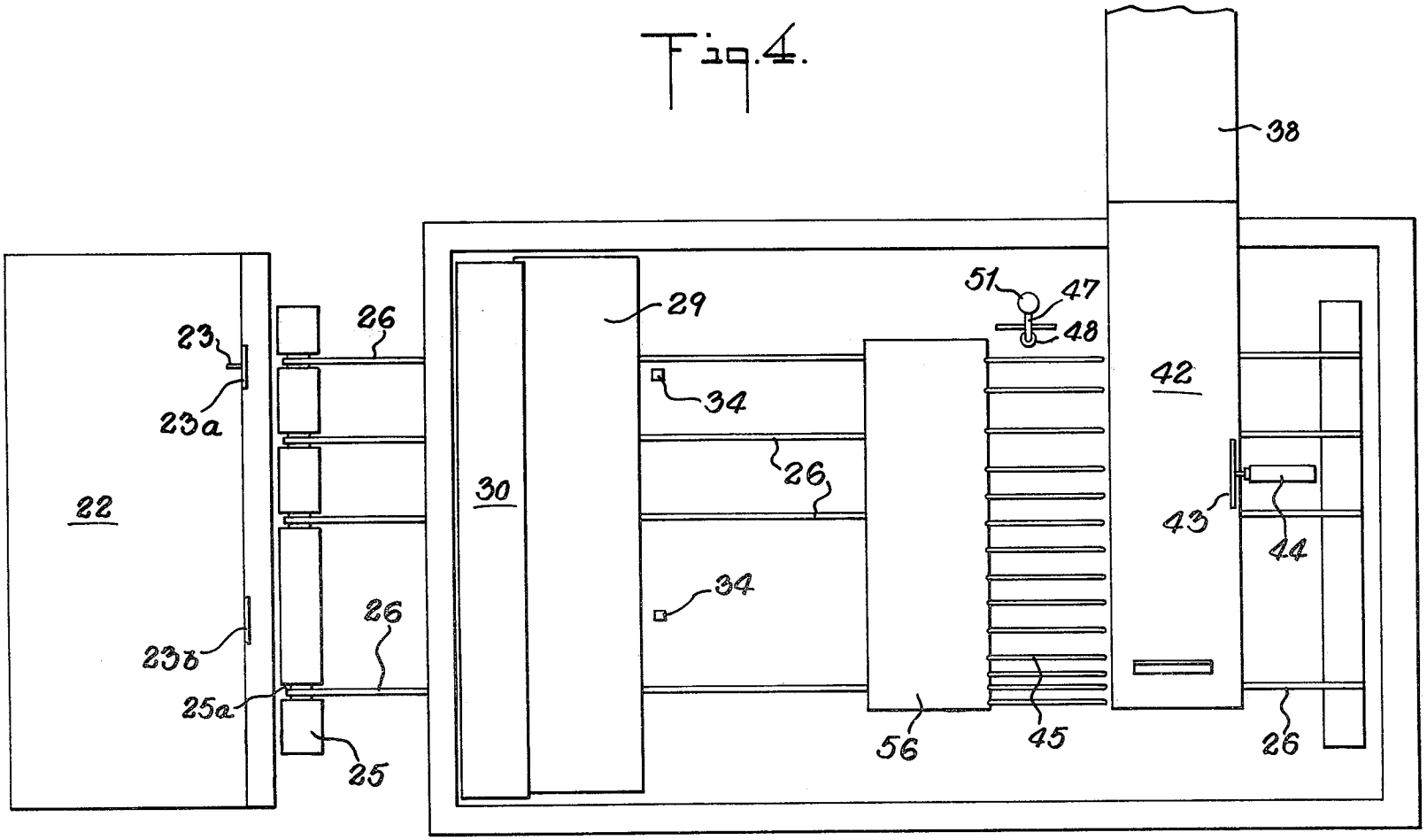
FIG. 4 is a top plan view of the machine of FIG. 3.

FIG. 4 shows a plan view of the machine. The flow of box blanks through this mechanism was described above. Partitions enter the machine at right angles to the flow of the box blanks, as indicated in the figure.

Partitions arrive at the machine shingled one atop the other, as they are produced on the partition machine. As the leading edge of this shingled stream of partitions enters the machine, the first partition is separated from the stream and fed out onto a receiving table, above the path of the blank. It will be understood that the other forms of partitions can be fed from a hopper (not shown) onto the conveyor 35 one at a time rather than in a shingled stream.

Referring again to FIG. 3, the partition is then moved parallel to, but in the opposite direction, of blank flow. It comes to rest against a series of stops which register it in the machine direction, which is synonymous with the direction of box depth.

Figure 8:
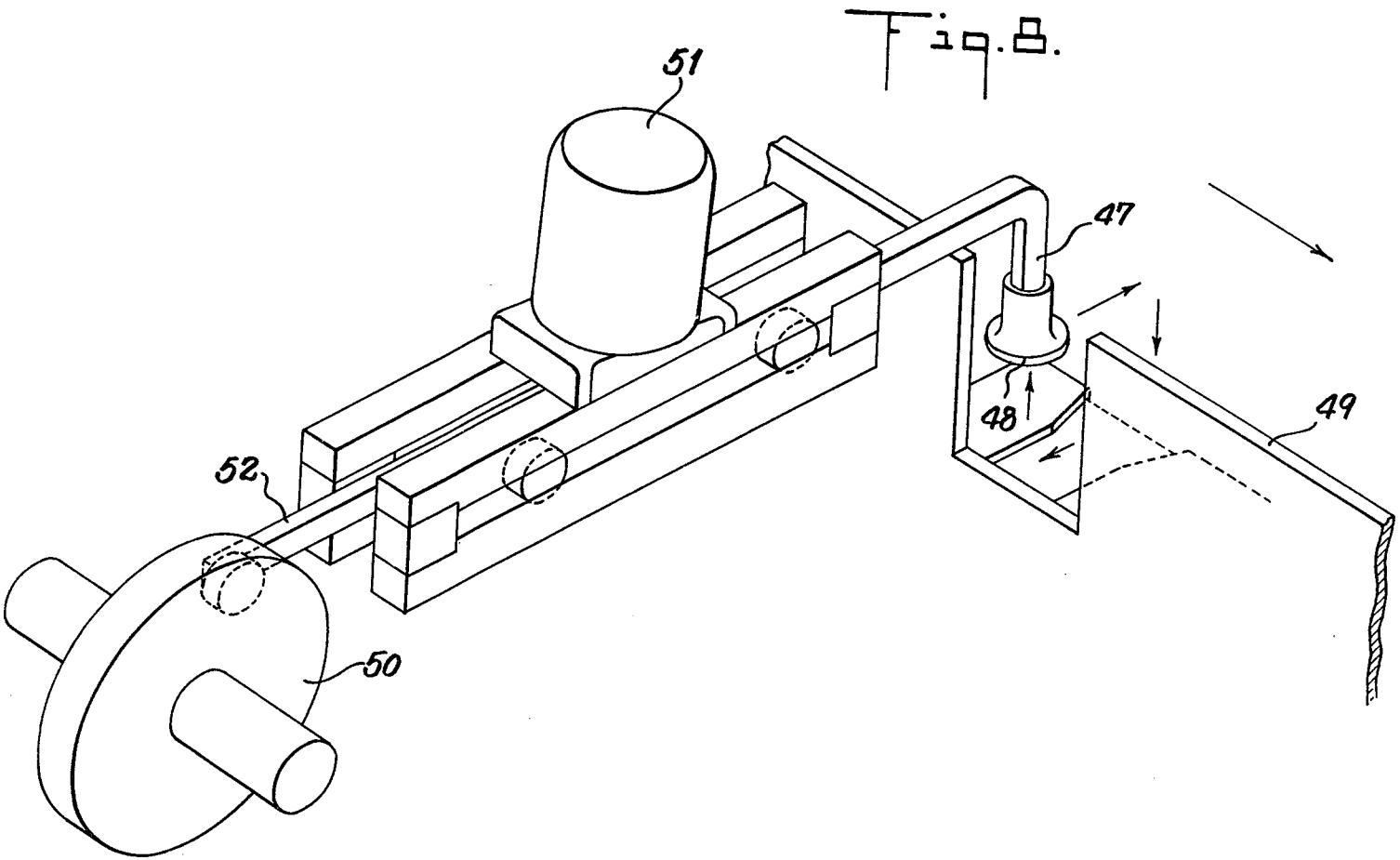
FIG. 8 is a perspective view of the side registration finger mechanism to position the partition laterally on the receiving table.
Figures 8, 10:
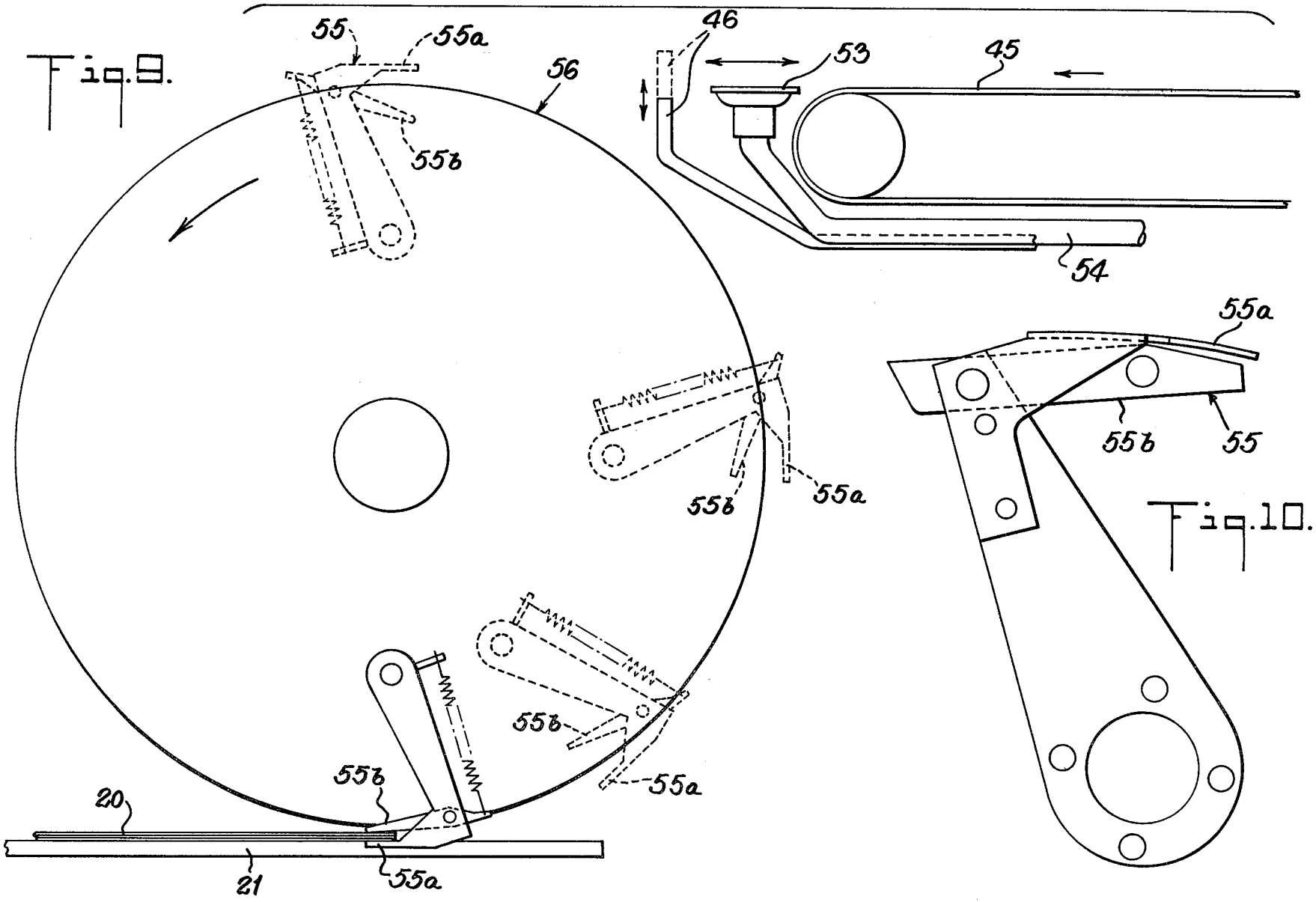
FIG. 10 is a side elevation of one of the grippers on the drum of FIG. 9.
Figure 11:
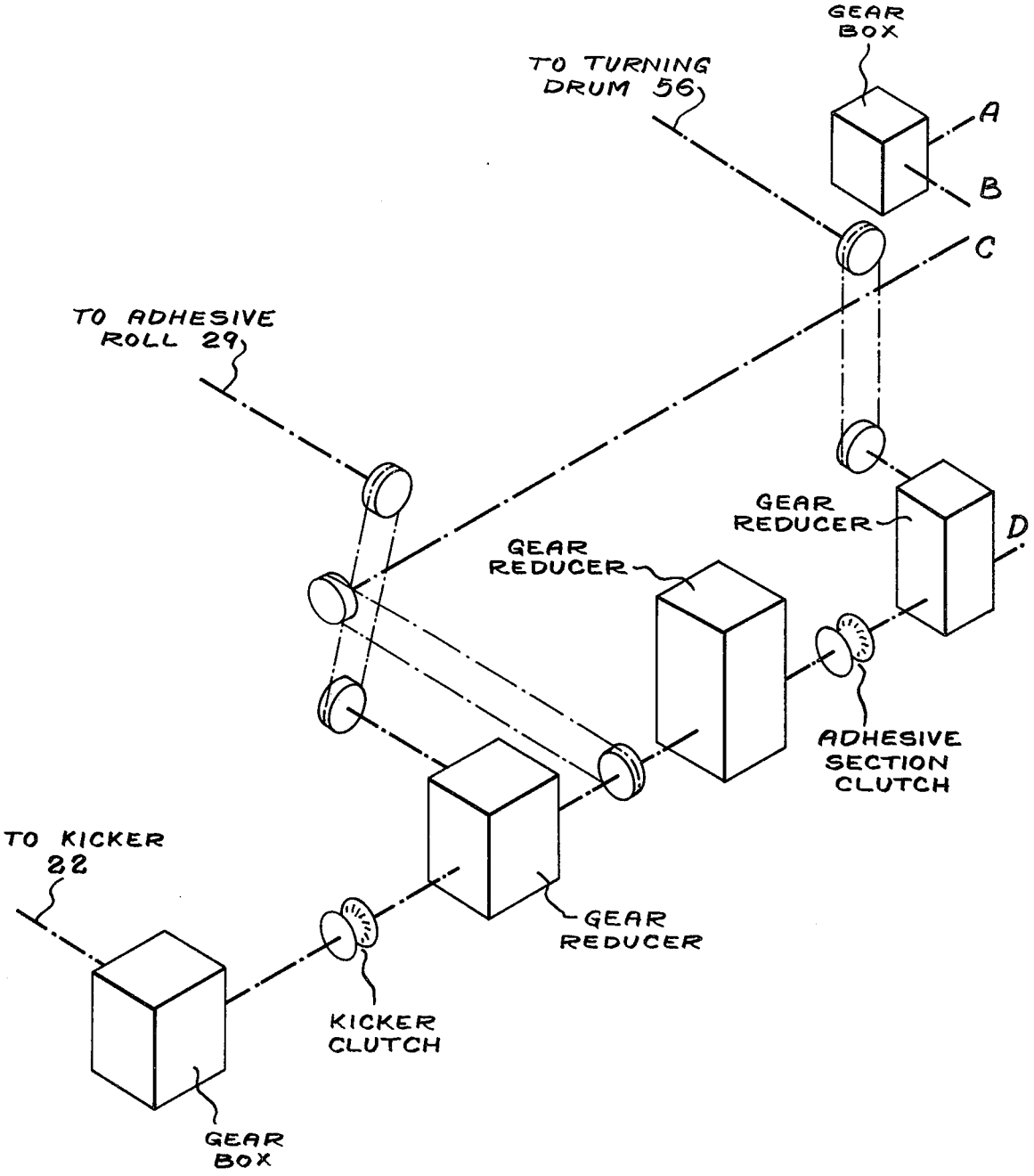
FIGS. 11 and 12 combined show an isometric view of the common drive system for the machine.
Figure 12:
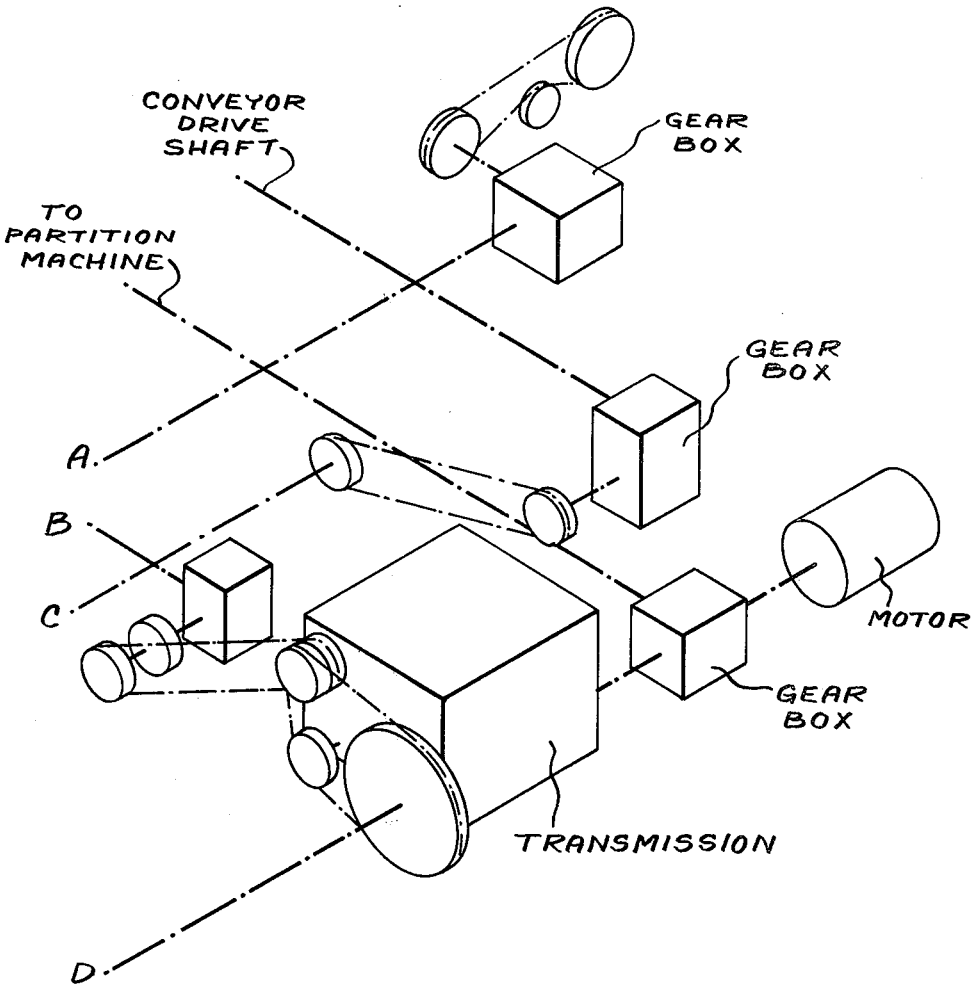

A finger mechanism indicated in FIG. 3 and shown in more detail in FIG. 8, then moves the partition laterally to bring it against a side stop, which registers it in the cross machine direction.

At the proper time in the cycle, the partition is advanced into grippers on the turning drum which carry it around and deposit it on the surface of the blank as the blank passes beneath the drum.

KICKER FEEDER

The kicker feeder 22 is a standard item which has been modified to some extent for this use. It includes a means of accurately positioning the blanks in the hopper so that the left hand slot 21*a* of each blank always falls in the same position relative to machine frame, regardless of blank size or design. This is accomplished by installing a narrow metal bar 23 on the face of the left hand feed gate 23*a*, which is fixed in position. This bar protrudes so that it engages the slot in each box as they are placed in the hopper. In this manner the entire stack of blanks is in alignment and each blank will be positioned accurately as it is fed from the kicker feeder into the blank conveyor. There is also a right feed gate 23*b*. These feed gates are positioned to permit only a single blank to feed from the bottom of the stack.

BLANK CONVEYOR

The blank conveyor (FIGS. 3 and 4) consists of a set of feed rollers 24 and 25 adjacent to the kicker feeder and four runs of roller chain 26 spaced across the width of the machine. The roller chains ride in slotted recesses 25*a* in the feed roller 25. The upper feed roller 24 also has slotted recesses 24*a* to provide clearance for pushers 27 affixed to the roller chains 26 (FIGS. 5 and 6).

Each of the pushers 27 is made up of an L-shaped member 27*a* affixed to the roller chain and a sword 27*b* likewise secured to the chain. The sword 27*b* projects over the rear edge of the blank and prevents the blank from riding over the top of the pusher. In addition the left most conveyor chain, which is on the fixed reference line, also carries a slot blade 28 affixed to the chain 26 just ahead of the pushers 27. This blade engages the slot 21*b* in the blank (FIG. 1) and holds the blank in lateral registration throughout its passage through the machine. The position of the slot blade 28 relative to the position of the pusher 27 must be varied for blanks with different flap configurations.

For blanks where the ends of the flaps are not in line the positions of the pushers 27 can be varied by shifting the roller chains 26 relative to each other.

ADHESIVE PRINTER

The general arrangement of this section is shown in FIG. 3. It consists of a large print roll 29 which carries a print mat for applying a pattern of adhesive 21*c* to the upper surface of the box blank. Controlled quantities of adhesive are applied to the print mat from the transfer roll 30. Adhesive is picked up by this roll from the pan 31 below it and excess adhesive doctored off by blade 32. This blade is easily adjustable so that the quantity of adhesive can be varied as desired.

The blank is held in position to contact the print mat by the backup plates 33 situated directly below the print cylinder. These plates are adjustable in height to compensate for variation in box blank thickness and to provide a means of adjusting print pressure.

Hot melt adhesive may be utilized to ensure a fast bite between the partition and the box and prevent relative motion of the two during the box folding operations which follow the assembly operation. This adhesive is applied by nozzles 34 in two short beads 21*d*, one just inside the left hand score of the blank, the other just inside the right hand score. Application is by conventional equipment. It will be understood that any quick tack adhesive or a double face adhesive tape may be used instead of the hot melt adhesive.

Although the adhesive pattern shows the adhesive lines running in the machine direction, it will be understood that such lines can run in other directions or that other configurations can be used.

SEPARATING AND HOLDING SECTION

Figure 7:
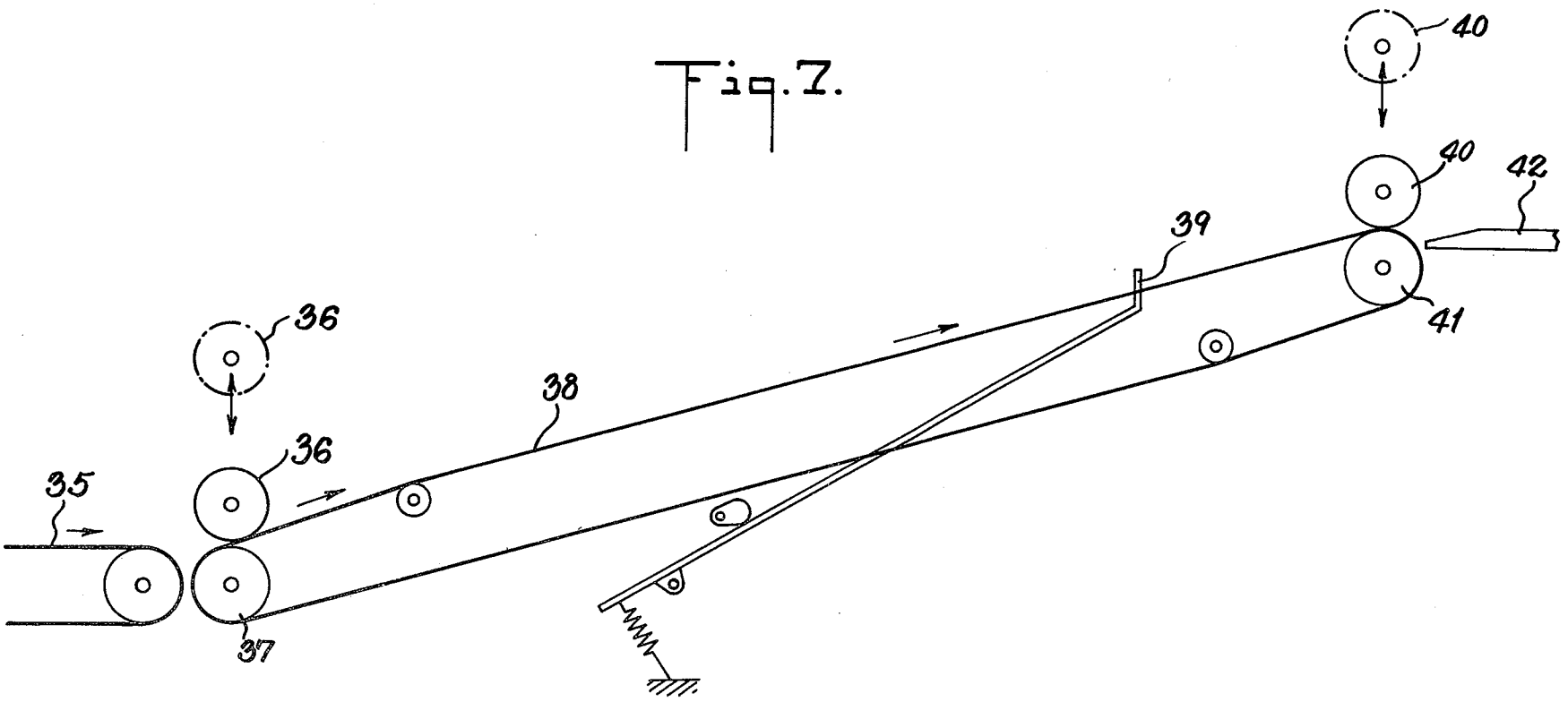
FIG. 7 is a side elevation of the separation and holding section of the machine for picking a single partition from the stream of overlapped partitions and advancing it to a receiving table over the machine.

A side elevation of this section appears in FIG. 7. Partitions enter this section by the conveyor 35. At specific, controlled intervals the separating rolls 36 and 37 are moved together to engage the leading edge of the leading partition and pull it out. The single partition is advanced on the series of tape conveyors 38 to spaced stops 39 positioned across the section. Again, at the proper point in the cycle, these stops are lowered and the partition advanced by the tape conveyor and a set of feed rollers 40 and 41 onto the receiving table 42. The stops 39 are spring loaded and normally in an "up" position. The lowering of the stops 39 is synchronized with the operation of the rest of the machine.

In the normal situation, with a partition resting on the receiving table, a pneumatically operated pusher 43 actuated by an air cylinder 44, shown in FIGS. 3 and 4 advances the partition onto a conveyor 45. This conveyor carries the partition against a series of stops 46 which register the partition precisely in the machine direction as described previously.

FIG. 8 shows the concept of a finger mechanism used to position the partition in the cross machine direction. After the partition is firmly against the stops 46 and is registered in the machine direction, a finger 47 reaches out over the partition, bringing a foot 48 into contact with its upper surface. This foot then serves to drag the partition laterally against a stop 49, which is the locator for the lateral position. The machine frame beneath where this finger mechanism operates is recessed, as shown in FIG. 8. The downward pressure of the finger deforms the partition into this recess, bending the paper in a way which gives the partition considerable stiffness thus preventing the partition from buckling or deforming when it comes against the stop. It will be noted that the finger is provided with horizontal and vertical motion to position the partition. This is accomplished by means of a rotatable cam 50 for horizontal motion and a pneumatic actuator 51 for vertical motion. The bar 52 for the finger is connected to the cam 50 and the actuator 51 through a roller mechanism to provide the desired motion.

TURNING DRUM SECTION

At the proper point in the machine cycle, after the partition has been registered in both machine and cross machine directions, the stops 46, shown in FIG. 6, drop out of the path of the partition and a series of suction cups 53 come up from beneath the partition and attach to its lower surface. This series of suction cups 53 is mounted on a frame 54 which moves the cups forward to advance the partition into the grippers 55 on the turning drum 56.

The turning drum is a rotating mechanism which carries a series of mechanically actuated jaws 55*a* and 55*b* which are in line across the face of the drum, parallel to the axis of rotation of the drum. As the jaws pass through the top position (FIG. 9) the suction cup mechanism mentioned previously overspeeds the partition so that it is driven into the jaws. Jaws and partition travel for a short distance at the same speed. During this interval, when there is no relative motion between the jaws and the partition, the jaws close, firmly gripping the partition. At this moment, the suction cups 53 release the partition and return to their original position ready to grip and move the next partition.

The turning drum grippers carry the partition 20 around and as they approach their lowest position, the partition is brought into contact with the surface of the box blank 21 and pressure is applied to hold the partition and blank in firm contact for a brief interval. In this interval, the gripper jaws open and tilt forward releasing the partition and moving out of the way of partition and blank.

The combined structure is then carried by the blank conveyor 26 into a folder which turns the outside panels of the blank through 180° superimposes them on top of the partition 21. The adhesive pattern on the blank serves to secure the partition to all four panels of the blank.

Figure 2:
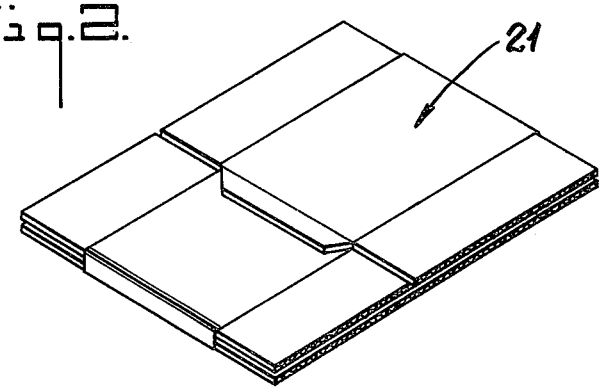
FIG. 2 is a perspective view showing the carton blank of FIG. 1 after the partition has been applied and the blank folded into a tube around the partition.

As the box blank/partition assembly enters the folder section, adhesive is applied to the box blank for making the manufacturer's joint and completing the formation of the blank into a tube, as shown in FIG. 2.

DRIVE SYSTEM

Both the partition machine (applications Ser. Nos. 143,391 and 433,978) and the machine of the present invention operate from a common drive system or from synchronized multiple drives.

The operation of the machine for combining a partition with a box blank to form a combination partition box in collapsed condition should be apparent from the foregoing description. The apparatus provides the means for producing such structure in a simple, economical and effective manner.

NEW FORMS OF PARTITIONS SHOWN IN FIG. 13

Figure 13A:
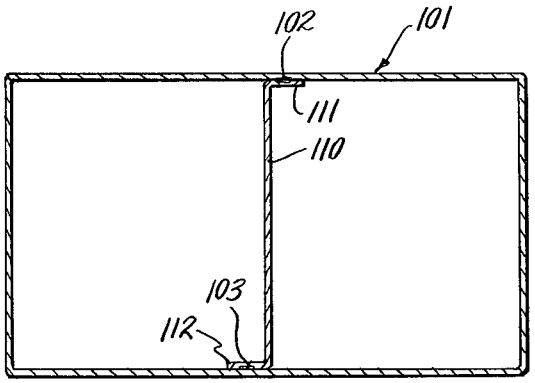
FIGS. 13*a* through 13*g* are diagrammatic transverse sectional views illustrating other forms of partitions or walls to be combined with the box blank.

FIG. 13*a* shows the simplest form of insert in which box blank 101 has applied within its interior surface lines of adhesive 102 and 103 on opposite faces of the single wall partition 110 whose flanges 111 and 112 are adhered by the adhesive lines 102 and 103 to the opposite interior walls which are the longer walls of the rectangular box blank. The adhesive in all of the embodiments shown in FIG. 13 may be overall, continuous lines or spaced (spots, bars or dotted) and extend substantially the entire length dimension of the flanges 111 and 112 to provide the desired bonding.

In the embodiment shown in FIG. 13*b* the bottom flange 113 is turned inwardly so that it lies below flange 111 at the opposite long wall of the box 101 and the flanges are adhered on the same face of the single wall partition 110.

Figure 13B:
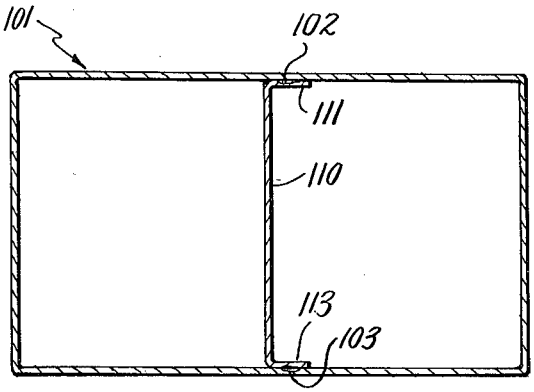
Figure 13C:
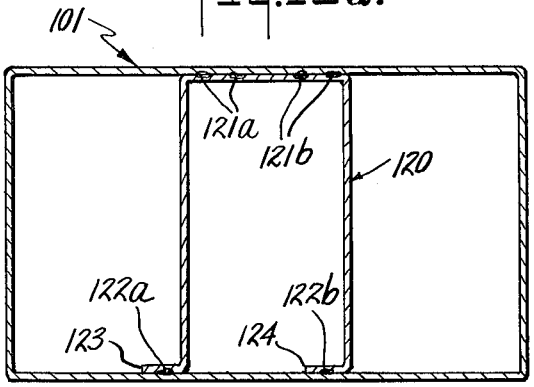

In the embodiment shown in FIG. 13*c* a three-sided generally rectangular partition 120, which itself is of U-shape, is illustrated and a series of adhesive lines [at the top of the partition] 121*a* and 121*b* are used on the closed wall of the partition to secure it to the inside long wall of the box while adhesive layers 122*a* and 122*b* secure flanges 123 and 124 to the opposite wall. It should be understood that the flanges 123 and 124 can point in opposite directions instead of as shown.

Figure 13D:
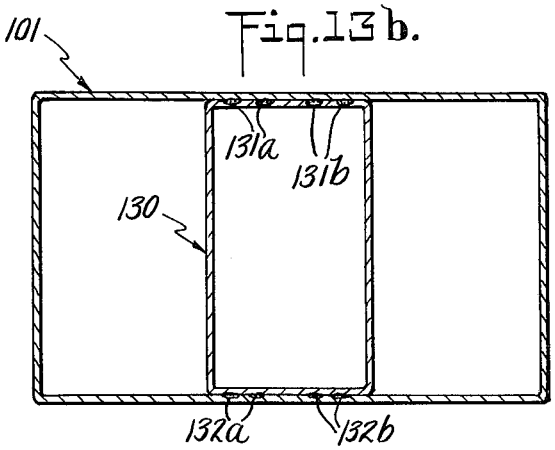

In FIG. 13*d* a box shaped partition 130 is secured within the box 101 and a series of lines of adhesive 131*a* and 131*b*, 132*a* and 132*b* secure the respective upper and lower walls.

Figure 13E:
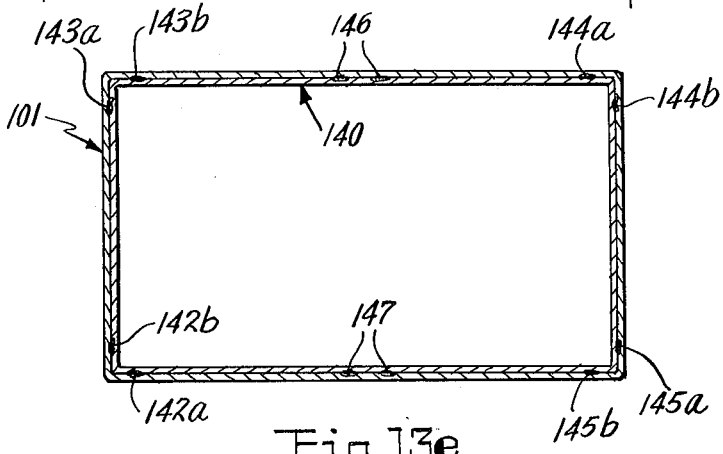

In the example shown in FIG. 13*e* box 140 having substantially the same outer wall dimensions as the inner wall dimensions of box 101 is positioned into the box blank in accordance with the method described hereinabove. There are lines of adhesive in each of the corners and also lines of adhesive at approximately the center portion of the inner walls. These lines are shown in FIG. 13*e* by reference numerals which start at the lower left hand corner at the bottom of the Figure and proceed in a clockwise direction, 142*a*, 142*b*, 143*a*, 143*b*, 144*a*, 144*b*, 145*a* and 145*b* to provide adhesive lines at the corners and 146 at the long wall center and 147 at the opposite long wall center. The application of the adhesive in this pattern at the corners and at the center portion of the longer walls permits a new and very efficient manufacturing operation for the creation of a box having a double wall thickness.

Figure 13F:
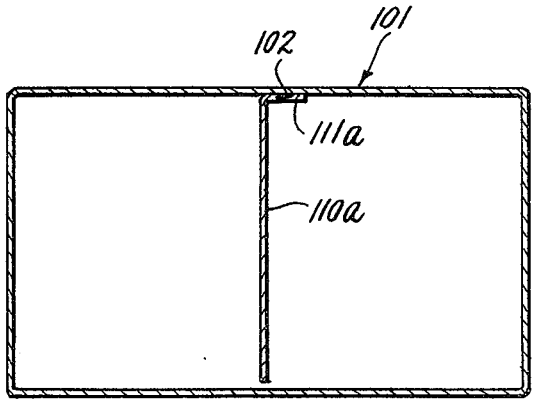
Figure 13G:
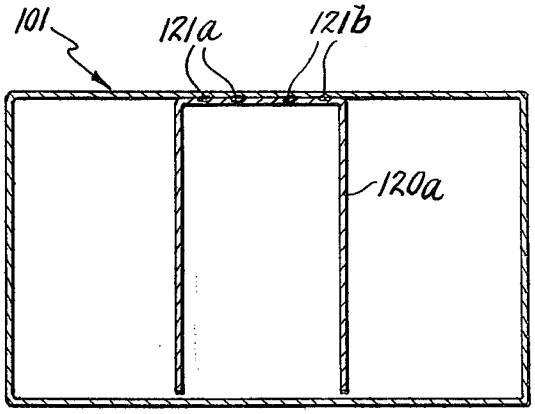

FIGS. 13*f* and 13*g* show partitions similar to those of FIGS. 13*a* and 13*c* but with only one end secured to one wall of the box with the other end of the partition free to float in the box to accommodate different sizes of items to be packaged. In such cases the flange or end portion at one end of the partition may be omitted.

It will be apparent that some forms of partition, such as that shown in FIG. 13*b* will require some prefolding of the flanges before positioning the partition on the box blank. Since this is an extra step, the positioning of the flanges, such as for the partition of FIG. 13*a*, and the partition of FIG. 13*c* with the flanges pointing in the same direction, will simplify the operation.

Where the term "wall" is used herein it should be understood that a wall can be formed of single, double or triple-wall corrugated board, fibreboard, or other suitable material.

Thus, among others, the several aforementioned objects and advantages are most effectively attained. Although a somewhat preferred embodiment of the invention has been disclosed and described in detail herein, it should be understood that this invention is in no sense limited thereby and its scope is to be determined by that of the appended claims.

Having described the invention, what is claimed is:

1. A method for combining a divided partition having end portions for adhesive engagement with inner opposite wall surfaces of a box blank, the blank having a plurality of panels and adapted to be folded into a tube comprising:

feeding a partition onto a continuously rotating turning drum;

gripping said partition by gripping means on the said drum to hold said partition in a predetermined position during rotation of the drum;

feeding a box blank onto a movable blank conveyor;

holding the box blank on the conveyor in a predetermined transverse position;

2. A method for combining a dividing partition having one end portion for adhesive engagement with a wall surface of a box blank, the blank having a plurality of panels and adapted to be folded into a tube comprising:

applying adhesive to the upper surface of the blank in a predetermined pattern to engage opposite end portions of the partition to the inner opposite walls of the box blank;

advancing the blank on the conveyor beneath said turning drum;

continuously rotating said drum while holding said partition and simultaneously advancing said blank and said conveyor to thereby place said partition on the blank in registration on a certain panel of said blank while said blank is so positioned on said conveyor; and, while in said registration, folding the panels of the box blank over the partition to complete the formation of a tube around the partition.

feeding a partition onto a continuously rotating turning drum;

gripping said partition by gripping means on the said drum to hold said partition in a predetermined portion during rotation of the drum;

feeding a box blank onto a movable blank conveyor;

holding the box blank on the conveyor in a predetermined transverse position;

applying adhesive lines to the upper surface of the blank in a predetermined pattern to engage said end portion of the partition to an inner wall of the box blank;

advancing the blank on the conveyor beneath said turning drum;

continuously rotating said drum while holding said partition and simultaneously advancing said blank and said conveyor to thereby place said partition on the drum in registration on a certain panel of the blank while said blank is so positioned in said registration on the conveyor; and, while in said registration, folding the panels of the box blank over the partition to complete the formation of a tube around the partition.

* * * * *

UNITED STATES PATENT OFFICE

CERTIFICATE OF CORRECTION

PATENT NO. : 3,930,438

DATED : January 6, 1976

INVENTOR(S) : Howard T. Hackman et al

It is certified that error appears in the above-identified patent and that said Letters Patent are hereby corrected as shown below:

Column 8, lines 4 - 8 should be placed after line 23.

Column 8, line 28, the word "portion" should be ---position---.

Signed and Sealed this

Twentieth Day of July 1976

[SEAL]

*Attest:*

RUTH C. MASON
*Attesting Officer*

C. MARSHALL DANN
*Commissioner of Patents and Trademarks*